US005253606A

United States Patent [19]

Ortelli

[11] Patent Number: 5,253,606

[45] Date of Patent: Oct. 19, 1993

[54] MACHINE FOR GRIPPING, SECURING AND HANDLING UNDERWATER VEHICLES AND THE LIKE

[75] Inventor: Aurelio Ortelli, Bologna, Italy

[73] Assignee: Riva Calzoni S.P.A., Milan, Italy

[21] Appl. No.: 943,009

[22] Filed: Sep. 9, 1992

[30] Foreign Application Priority Data

Sep. 10, 1991 [IT] Italy ..... MI91A 002388

[51] Int. Cl.[5] ..... B63B 23/00

[52] U.S. Cl. ..... 114/259; 114/51; 114/370

[58] Field of Search ..... 114/242, 243, 244, 245, 114/246, 247, 253, 254, 259, 51, 268, 370

[56] References Cited

U.S. PATENT DOCUMENTS 4,516,517 5/1985 Ayers ..... 114/246
4,711,196 12/1987 Wilks ..... 114/253
5,140,927 8/1992 Tolefson ..... 114/253

FOREIGN PATENT DOCUMENTS 3900885 7/1990 Fed. Rep. of Germany .
2150903 7/1985 United Kingdom .

*Primary Examiner*—David M. Mitchell
*Assistant Examiner*—Stephen P. Avila
*Attorney, Agent, or Firm*—Herbert Dubno; Yuri Kateshov

[57] ABSTRACT

A machine for gripping and handling underwater vehicles and the like includes a gripping device provided with a guiding member made integral at its upper end, an articulated member connected with a rod sliding inside a guide attached to a free end of a jib of the crane and with floats capable of maintaining the guiding member raised above the water in a preset position of the rod relative to the guide controlled by a sensor imparting movement to the jibs of the crane in order to maintain the gripping device in vertical position relative to the ship.

9 Claims, 2 Drawing Sheets

MACHINE FOR GRIPPING, SECURING AND HANDLING UNDERWATER VEHICLES AND THE LIKE

FIELD OF THE INVENTION

This invention relates to a machine for gripping, securing and handling underwater vehicles and the like, particularly from the side ships.

BACKGROUND OF THE INVENTION

It is known that at sea use is made of various types of underwater vehicles, either for civilian or military purposes, which are put into the water and recovered from the side of ships equipped for this purpose.

The operations of launching and recovering such vehicles always prove particularly difficult. However, because of the difficulties of manoeuvring them due to the impossibility of maintaining a stable relative position between the waterborne vehicle and the ship because of the wave motion which brings about oscillations of both the vehicle and the ship. Such variation in the relative position of the vehicle with regard to the ship both on the horizontal plane and on the vertical plane therefore hampers the operations for gripping the vehicle, making it very often necessary to resort to putting personnel into the water to perform directly the task of attaching the hook of a hoisting crane to the point of attachment of the vehicle. This operation involves, given the proximity to the side of the ship, hazardous conditions and high risks for such personnel whose presence in the water will be particularly necessary under bad weather and rough sea conditions which obviously bring about a further increase in such risk.

There are known certain conventional solutions which provide for attaching the vehicle by means of a hook located at the end of a rope leading to the winch of a crane. Such solutions, however, not only do not make it possible to grip the vehicle, but also pose a disadvantage because of the fact that at the time of hoisting the vehicle from the water the latter is not rigidly linked and therefore may oscillate and/or rotate around the vertical axis, thus increasing the difficulties of handling in order to transfer it to the stowage point aboard the ship. The handling personnel must in this case secure the vehicle using other ancillary means, for example ropes, to avoid or reduce such oscillation and rotation.

This, creates other operational difficulties and risks, particularly when the ship is undergoing severe oscillation.

OBJECTS OF THE INVENTION

It is therefore an object of the present invention to provide a machine for hooking and handling underwater vehicles performing the attachment of the waterborne vehicle in a safe manner and without the intervention of immersed personnel, even under the most difficult weather conditions; and still another object of the invention is to provide such a machine which ensures safe gripping and rigid maintenance of the position of the vehicle, avoiding oscillation and/or rotation thereof. Yet another object is to provide a machine to be easily assembled on ships already equipped with devices of conventional type, and capable of being converted into auxiliary service equipment for operations of conventional type.

SUMMARY OF THE INVENTION

Such results are obtained with the present invention, which provides a machine for gripping, securing and handling underwater vehicles and the like comprising a crane mounted aboard a ship and fitted at its free end with a gripping device, the device is substantially comprised of a guiding member made integral at its upper end, through an articulated member capable of allowing swivelling of the device relative to two coplanar axes at right angles to one another, with a rod capable of sliding inside a guide attached to the free end of the crane jib and with floating members capable of maintaining the guiding member raised above the water, means for the retention and locking of a fixed member integral with the vehicle to be hoisted, as well as means for detecting the position of the rod relative to the guide, means for imparting movement to the crane jibs which, together with the action performed by the floats, maintain a constant distance between the gripping device and the surface of the water and which, together with the rotatability of the crane turret, make it possible to operate the device parallel to the surface of the water, and means for maintaining the device in a vertical position relative to the ship.

More particularly, it is provided that such guiding member is of substantially a "V" shape on the vertex of which is located a slot the opening of which receives means of retention substantially consisting of a pair of pawls, hinged to pins located vertically and capable of rotating towards the inside of the slot under the thrust action exerted by the pin of the vehicle and against the thrust action of springs or the like capable of maintaining the pawls in a closed position. And means for the return of such pawls for controlled opening thereof is also provided.

According to the invention the articulation is preferably a universal joint. Furthermore the rod and guide are of prismatic section in order to allow relative sliding in the vertical direction and prevent relative rotation between the rod and guide, while the locking means comprises pair of hydraulic devices arranged against one another integrally with the guiding member and in line with the vertex slot in order to exert tightening action on the pin and lock it in relation to the gripping device. The vertical pin is furthermore made integral at its upper end with a horizontal disc capable of preventing downward dislodgement of the pin when the latter is inserted into the slot of the guiding member.

Provision is also made for mean for maintaining the vertical position of the device relative to the vessel to be preferably comprised of an articulated parallelogram having ends respectively integral with the guides and with the crane turret.

BRIEF DESCRIPTION OF THE DRAWING

The above and further objects, advantages and details will become more readily apparent from the following description, references being made to the accompanying drawings, which show.

SPECIFIC DESCRIPTION

Figure 1:
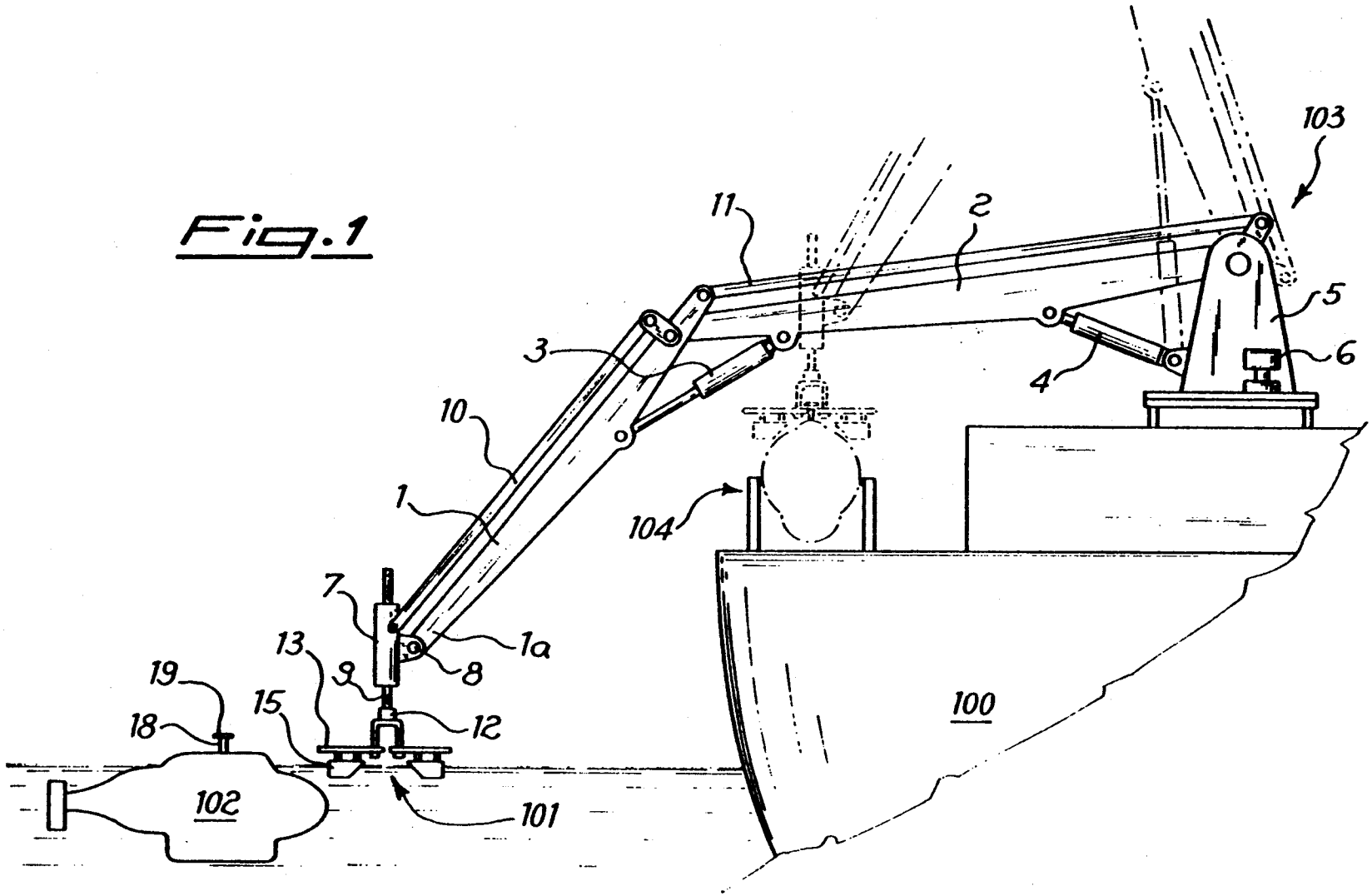
FIG. 1 is a diagrammatic view of the gripping and handling device mounted on a ship.
Figure 2:
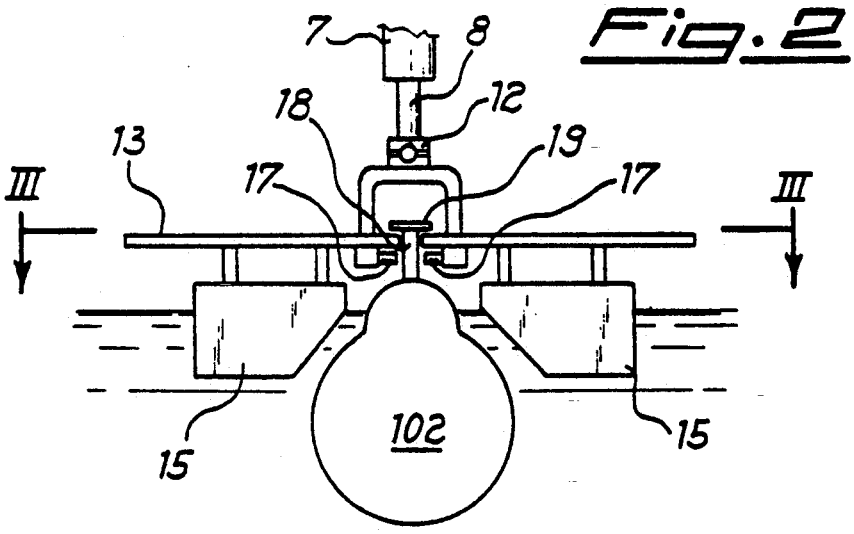
FIG. 2 is a side elevational view of the gripping device according to the invention.
Figure 3:
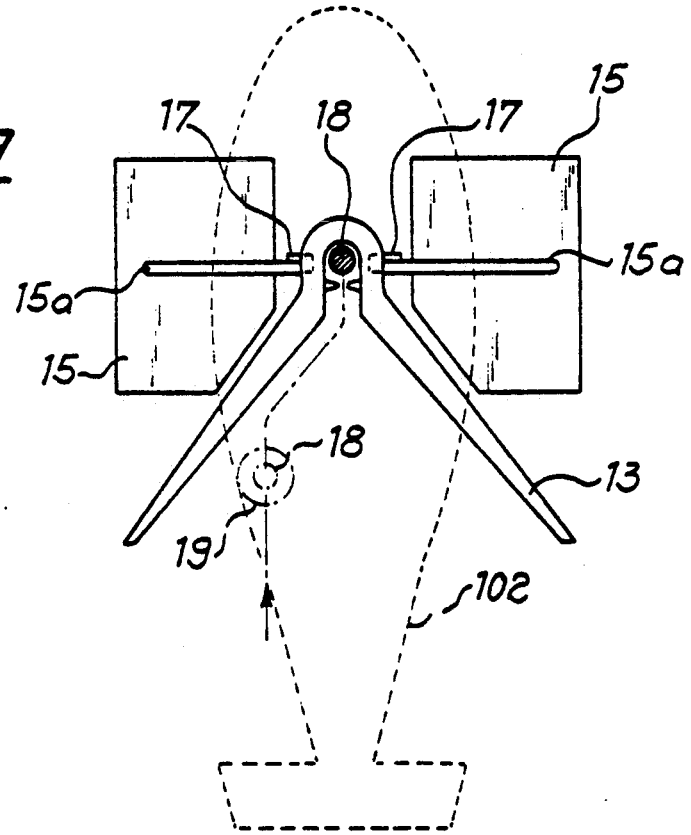
FIG. 3 is a cross-sectional elevational view taken along line III—III of FIG. 2.

As shown in FIG. 1, there is installed aboard a ship 100 a hoisting crane 103 consisting of two jibs 1 and 2 operated by two hydraulic cylinders 3 and 4 and capable of rotating around the vertical axis by means of a turret 5 equipped with a suitable slewing motor 6.

At a free end 1*a* of jib 1 gripping device 101 is made integral, via a hinged guide 7, by means of a pin 8, with free end 12 of second jib 1 of crane 103. Within such guide 7 is inserted a rod 9 which is of prismatic cross-section in order to prevent it from rotating about its own axis. Prismatic rod 9 may however move vertically in relation to its own guide 7.

Guide 7 and therefore its rod 9 are maintained vertical relative to the ship by a mechanical device of articulated parallelogram type 10 and 11 or another known equivalent type. At the lower end rod 9 is provided with a universal joint 12 to which is connected device 101 for securing vehicle 102.

Such device consists of a member 13 of substantially "V" shape ending at its vertex in a slot 14.

Figure 4:
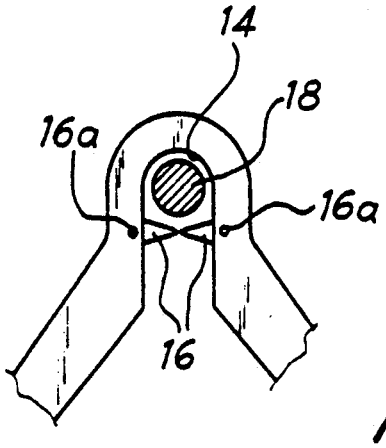
FIG. 4 is a detail of the gripping member.

Underneath such V-shaped member (FIG. 4) provided two floats 15, of suitable shape and dimensions, which are attached to the gripping member via cross-pieces 15*a* coplanar with the legs of V-shaped member 13.

At the entrance to slot 14 the V-shaped member has (FIG. 4) two pawls 16 articulated to pins 16*a* around which they can rotate, pawls 16 being normally maintained in closed position by means of a spring, which is self-evident and not illustrated, against the thrust action of which the pawls can open into slot 14 either by the thrust action exerted by a body coming into contact or by operator control.

Securing device 101 is furthermore equipped with two hydraulic clamping devices 17 which, as will be described later, are capable of tightening a pin located between them.

The entire clamping device 101 is moreover provided with means for controlling capable of imparting rotary movement around the vertical axis of the device.

Vehicle 102 which is to be secured by device 13 will be provided at its upper part with a cylindrical pin 18 terminating at its upper end in a disc 19.

The operation of the system is as follows: underwater vehicle 102, which is brought to the surface by its own means, may be manoeuvred in order to approach the gripping device and be oriented in the most suitable manner.

From the surface of the water the vehicle rises slightly so that the entire attachment pin 18 is located above water level, while end device 101 is lowered to the level of the water by crane 103 and maintained at a virtually constant distance from the surface of the waters, and substantially parallel thereto, through the action of floats 15 combined with that of universal joint 12.

Obviously the maximum reach capable of being achieved by device 101 depends on the length of prismatic guide 9, and when the latter moves away from the central position relative to its guide 8 a suitable sensor located on the guide controls, via an electronic system, the movement of crane 103, which acts in a coordinated manner upon two hydraulic cylinders 3,4 in such a way as to shift the device 101 along the surface while guide 9 is displaced vertically to compensate for the vertical movement imparted by the water relative to the ship.

In other words the electrohydraulic servo enables end part 101 of crane 103, and therefore its gripping device 13, to remain substantially at water level and travel over a considerable distance, while floats 15 and the relevant prismatic guide 9 compensate for the minor rapid fluctuations in level.

The on-board operator may then, if so desired, apply to end part 101 of crane 103 a movement in the horizontal plane either transversally, by acting in a coordinated manner on cylinders 3,4 via the electrohydraulic servo, or in the longitudinal direction by bringing about the rotation of crane turret 5.

V-shaped member 13 may therefore be moved over the surface of the water within a certain specified area and/or be caused to rotate on its vertical axis in order to swivel such V-shaped member in the most suitable direction.

At this stage, vehicle 102 is made to approach V-shaped member 13, which is in turn manoeuvred into the most favorable position, but with the opening of the V turned toward pin 18, Until the pin lines up with the V-shaped member and enters into slot 14, thus opening pawls 16 which, on reclosing due to the action of the spring, prevent it from working loose, while disc 19 on pin 18 likewise prevents the vehicle from slipping down.

In order to avoid uncontrolled rotation of the vehicle, there then come into operation two hydraulic devices 17 to lock pin 18. The vehicle is therefore rigidly attached to the crane 103 and may be hoisted.

It is furthermore clear that, by means of the machine according to the invention, it is possible to control the rotation of end device 101 in order to swivel vehicle 102 for correct positioning thereof on its stowage cradle 104 aboard ship 100.

Obviously, launching the vehicle substantially involves performing the same operations in reverse order.

Many alternatives may be introduced to the constructional design of the constituent parts of the machine without thereby departing from the scope of the invention in regard to its general features.

I claim:

1. A machine for gripping and handling an underwater vehicle provided with an extension projecting above a water surface, said machine being mounted on a ship and comprising:

a turret mounted rotatably about a turret axis on a ship;

a crane mounted on said turret and provided with a pair of jibs pivotally connected with one another, one of said jibs being formed with a free end;

actuating means for displacing said jibs;

a guide extending along a guide axis and mounted on said free end of said one of said jibs;

a rod coaxial with and slidable in said guide, said rod being formed with a respective free end projecting axially toward a water surface from said guide;

an articulated member mounted rotatably about said guide axis on said free end of said rod, said articulate member swivelling about a swivel axis extending perpendicular to an axis of said guide and being axially fixed to said rod to move therewith axially;

a gripper mounted rigidly on said articulated member for engaging said extension of a vehicle to be handled;

retaining means on said gripper for retaining said extension of the vehicle to be handled upon gripping thereof by said gripper;

floating means mounted on said articulated member and riding in the water for supporting said gripper on the surface;

controlling means operatively connected with said rod and said guide for controlling a preset axial position of said rod relative to said guide; and means on said jibs for maintaining said guide axis and said turret axis parallel to one another.

2. The machine defined in claim 1 wherein said gripper has a substantially "V" shape and is formed with a vertex receiving said retaining means, said vertex being provided with a slot receiving the extension of the vehicle.

3. The machine defined in claim 2 wherein said retaining means includes:

a pair of parallel pins on said gripper, a pair of pawls mounted on respective pins and rotatable inwardly toward said slot between closed and open positions, and spring means for returning said pawls into said closed position upon gripping the extension of the vehicle.

4. The machine defined in claim 1 wherein said articulated member is a universal joint.

5. The machined defined in claim 1 wherein said rod and said guide have respective prismatic cross sections.

6. The machined defined in claim 1 wherein said retaining means, further comprising locking means for rotationally arresting the extension against said gripper upon gripping.

7. The machine defined in claim 6 wherein said locking means includes a pair of hydraulic devices on said gripper extending inwardly toward the extension upon gripping thereof.

8. The machine defined in claim 1, further comprising electrohydraulic means for controlling displacement of said jibs, said control means including at least one sensor operatively connected with said electrohydraulic means.

9. The machine defined in claim 1 wherein said means on said jibs includes links forming articulated parallelograms with said jibs connected between said guide and said turret.

* * * * *